US011211020B2

(12) United States Patent
Ono et al.

(10) Patent No.: US 11,211,020 B2
(45) Date of Patent: Dec. 28, 2021

(54) HIGH FRAME RATE DISPLAY

(71) Applicant: Apple Inc., Cupertino, CA (US)

(72) Inventors: Shinya Ono, Cupertino, CA (US); Zino Lee, Gyeonggi (KR); Gihoon Choo, Santa Clara, CA (US); Hassan Edrees, Cupertino, CA (US); Chin-Wei Lin, San Jose, CA (US)

(73) Assignee: Apple Inc., Cupertino, CA (US)

( * ) Notice: Subject to any disclaimer, the term of this patent is extended or adjusted under 35 U.S.C. 154(b) by 41 days.

(21) Appl. No.: 16/369,319

(22) Filed: Mar. 29, 2019

(65) Prior Publication Data

US 2019/0228726 A1 Jul. 25, 2019

Related U.S. Application Data

(63) Continuation-in-part of application No. 16/120,076, filed on Aug. 31, 2018.

(60) Provisional application No. 62/561,583, filed on Sep. 21, 2017.

(51) Int. Cl.

| | |
|---|---|
| ***G09G 3/36*** | (2006.01) |
| ***G09G 3/3225*** | (2016.01) |
| ***G09G 3/3291*** | (2016.01) |
| ***G09G 3/3233*** | (2016.01) |
| ***G09G 3/3266*** | (2016.01) |

(52) U.S. Cl.

CPC ..... *G09G 3/3648* (2013.01); *G09G 3/3225* (2013.01); *G09G 3/3233* (2013.01); *G09G 3/3266* (2013.01); *G09G 3/3291* (2013.01); *G09G 2300/0819* (2013.01); *G09G 2300/0842* (2013.01); *G09G 2310/0297* (2013.01); *G09G 2320/0209* (2013.01); *G09G 2320/0295* (2013.01)

(58) Field of Classification Search

CPC ..... G09G 3/3275; G09G 3/3233

See application file for complete search history.

(56) References Cited

U.S. PATENT DOCUMENTS

| | | | |
|---|---|---|---|
| 8,169,556 | B2 | 5/2012 | Oh et al. |
| 8,847,867 | B2 | 9/2014 | Zhang |

(Continued)

FOREIGN PATENT DOCUMENTS

| | | | |
|---|---|---|---|
| EP | 2189969 | A2 | 5/2010 |

*Primary Examiner* — Kent W Chang
*Assistant Examiner* — Chayce R Bibbee
(74) *Attorney, Agent, or Firm* — Treyz Law Group, P.C.; Jason Tsai

(57) ABSTRACT

A display may have rows and columns of pixels. Gate lines may be used to supply gate signals to rows of the pixels. Data lines may be used to supply data signals to columns of the pixels. The data lines may include alternating even and odd data lines. Data lines may be organized in pairs each of which includes one of the odd data lines and an adjacent one of the even data lines. Demultiplexer circuitry may be configured dynamically during data loading and pixel sensing operations. During data loading, data from display driver circuitry may be supplied, alternately to odd pairs of the data lines and even pairs of the data lines. During sensing, the demultiplexer circuitry may couple a pair of the even data lines to sensing circuitry in the display driver circuitry and then may couple a pair of the odd data lines to the sensing circuitry.

19 Claims, 20 Drawing Sheets

(56) References Cited

U.S. PATENT DOCUMENTS

| | | | | |
|---|---|---|---|---|
| 2007/0057877 | A1* | 3/2007 | Choi | G09G 3/3291 345/76 |
| 2008/0024408 | A1 | 1/2008 | Sano et al. | |
| 2009/0213286 | A1* | 8/2009 | Kim | G02F 1/136286 349/39 |
| 2009/0225009 | A1* | 9/2009 | Ka | G09G 3/3283 345/76 |
| 2011/0122173 | A1 | 5/2011 | Sehata et al. | |
| 2011/0248906 | A1* | 10/2011 | Asano | G09G 3/3291 345/55 |
| 2012/0299970 | A1 | 11/2012 | Bae et al. | |
| 2017/0025487 | A1 | 1/2017 | Byun et al. | |
| 2017/0076665 | A1* | 3/2017 | Kim | G09G 3/3275 |
| 2017/0176793 | A1* | 6/2017 | Choi | H01L 29/41775 |
| 2018/0190750 | A1* | 7/2018 | Choi | H01L 27/3276 |

* cited by examiner

HIGH FRAME RATE DISPLAY

This application is a continuation-in-part of U.S. application Ser. No. 16/120,076, filed Aug. 31, 2018, which is hereby incorporated by reference herein in its entirety, and which claims the benefit of provisional patent application No. 62/561,583, filed Sep. 21, 2017, which is hereby incorporated by reference herein in its entirety.

BACKGROUND

This relates generally to electronic devices, and, more particularly, to electronic devices with displays.

Electronic devices such as cellular telephones, computers, and other electronic devices often contain displays. A display includes an array of pixels for displaying images. Display driver circuitry such as data line driver circuitry may supply data signals to the pixels. Gate line driver circuitry in the display driver circuitry can be used to provide control signals to the pixels.

It can be challenging to provide display driver circuitry for a display. If care is not taken, frame rates will be too low or display performance will otherwise not be satisfactory.

SUMMARY

A display may have rows and columns of pixels. Gate lines may be used to supply gate line signals to rows of the pixels. Data lines may be used to supply data signals to columns of the pixels. The data lines may include alternating even and odd data lines. Data lines may be organized in pairs each of which includes one of the odd data lines and an adjacent one of the even data lines. Columns of pixels with mirrored layouts may flank each pair of data lines.

Demultiplexer circuitry may be configured dynamically during data loading and pixel sensing operations. During data loading, data from display driver circuitry may be supplied, alternately, to odd pairs of the data lines and even pairs of the data lines. During sensing, the demultiplexer circuitry may couple a pair of the even data lines to sensing circuitry in the display driver circuitry and then may couple a pair of the odd data lines to the sensing circuitry.

Configurations in which pixels in alternating rows are coupled alternately to the odd and even data lines and configurations in which rows of pixels each include multiple gate lines may also be used. Configurations for reducing vertical column crosstalk and for reducing the difference in parasitic capacitance between odd and evens rows are also provided.

DETAILED DESCRIPTION

Figure 1:
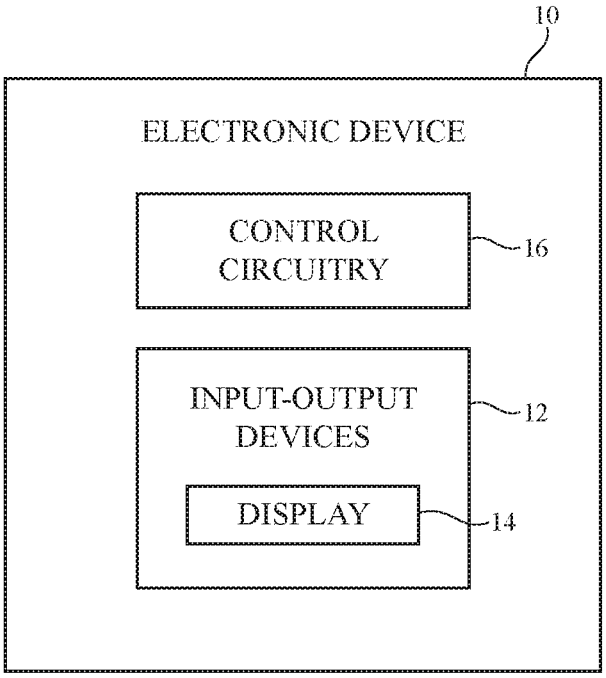
FIG. 1 is a schematic diagram of an illustrative electronic device having a display in accordance with an embodiment.

An illustrative electronic device of the type that may be provided with a display is shown in FIG. 1. Electronic device 10 of FIG. 1 may be a tablet computer, laptop computer, a desktop computer, a monitor that includes an embedded computer, a monitor that does not include an embedded computer, a display for use with a computer or other equipment that is external to the display, a cellular telephone, a media player, a wristwatch device or other wearable electronic equipment, or other suitable electronic device.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Display 14 may have a rectangular shape (i.e., display 14 may have a rectangular footprint and a rectangular peripheral edge that runs around the rectangular footprint) or may have other suitable shapes. Display 14 may be planar or may have a curved profile. Display 14 may be an organic light-emitting diode display or other suitable type of display.

Figure 2:
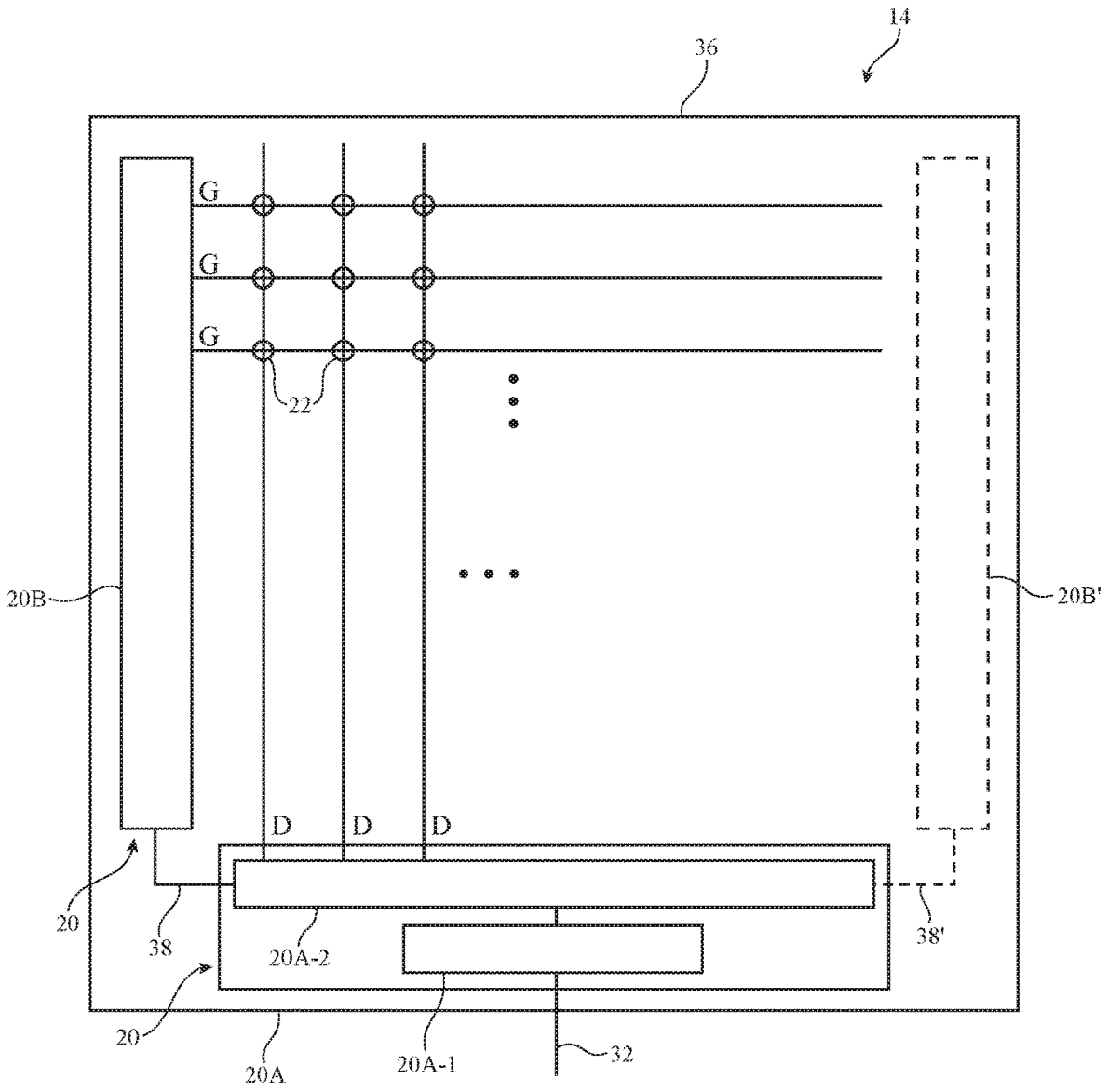
FIG. 2 is a top view of an illustrative display in an electronic device in accordance with an embodiment.

A top view of a portion of display 14 is shown in FIG. 2. As shown in FIG. 2, display 14 may have an array of pixels 22 formed from substrate structures such as substrate 36. Substrates such as substrate 36 may be formed from glass, metal, plastic, ceramic, or other substrate materials. Pixels 22 may receive data signals over signal paths such as data lines D and may receive one or more control signals over control signal paths such as gate lines G (sometimes referred to as control lines, scan lines, emission enable control lines, gate signal paths, etc.). There may be any suitable number of rows and columns of pixels 22 in display 14 (e.g., tens or more, hundreds or more, or thousands or more). Pixels 22 may have different colors (e.g., red, green, and blue) to provide display 14 with the ability to display color images. Pixels 22 may contain respective light-emitting diodes and pixel circuits that control the application of current to the light-emitting diodes. The pixel circuits in pixels 22 may contain transistors (e.g., thin-film transistors on substrate 36) having gates that are controlled by gate line signals on gate lines G.

Display driver circuitry 20 may be used to control the operation of pixels 22. Display driver circuitry 20 may be formed from integrated circuits, thin-film transistor circuits, or other suitable circuitry. Thin-film transistor circuitry for display driver circuitry 20 and pixels 22 may be formed from polysilicon thin-film transistors, semiconducting-oxide thin-film transistors such as indium gallium zinc oxide transistors, or thin-film transistors formed from other semiconductors.

Display driver circuitry 20 may include display driver circuits such as display driver circuitry 20A and gate driver circuitry 20B. Display driver circuitry 20A may include a display driver circuit 20A-1 that is formed from one or more display driver integrated circuits (e.g., timing controller integrated circuits) and/or thin-film transistor circuitry and may include demultiplexer circuitry 20A-2 (e.g., a demultiplexer formed from thin-film transistor circuitry or formed in an integrated circuit). Gate driver circuitry 20B may be formed from gate driver integrated circuits or may be formed from thin-film transistor circuitry.

Display driver circuitry 20A may contain communications circuitry for communicating with system control circuitry such as control circuitry 16 of FIG. 1 over path 32. Path 32 may be formed from traces on a flexible printed circuit or other conductive lines. During operation, the control circuitry (e.g., control circuitry 16 of FIG. 1) may supply circuitry 20A with information on images to be displayed on display 14.

To display images on display pixels 22, display driver circuitry 20A may supply image data to data lines D while issuing control signals (e.g., clock signals, a gate start pulse, etc.) to supporting display driver circuitry such as gate driver circuitry 20B over path 38. Circuitry 20A may also dynamically adjust demultiplexer circuitry 20A-2 by supplying clock signals (select signals) and other control signals to demultiplexer circuitry 20A-2.

Figure 3:
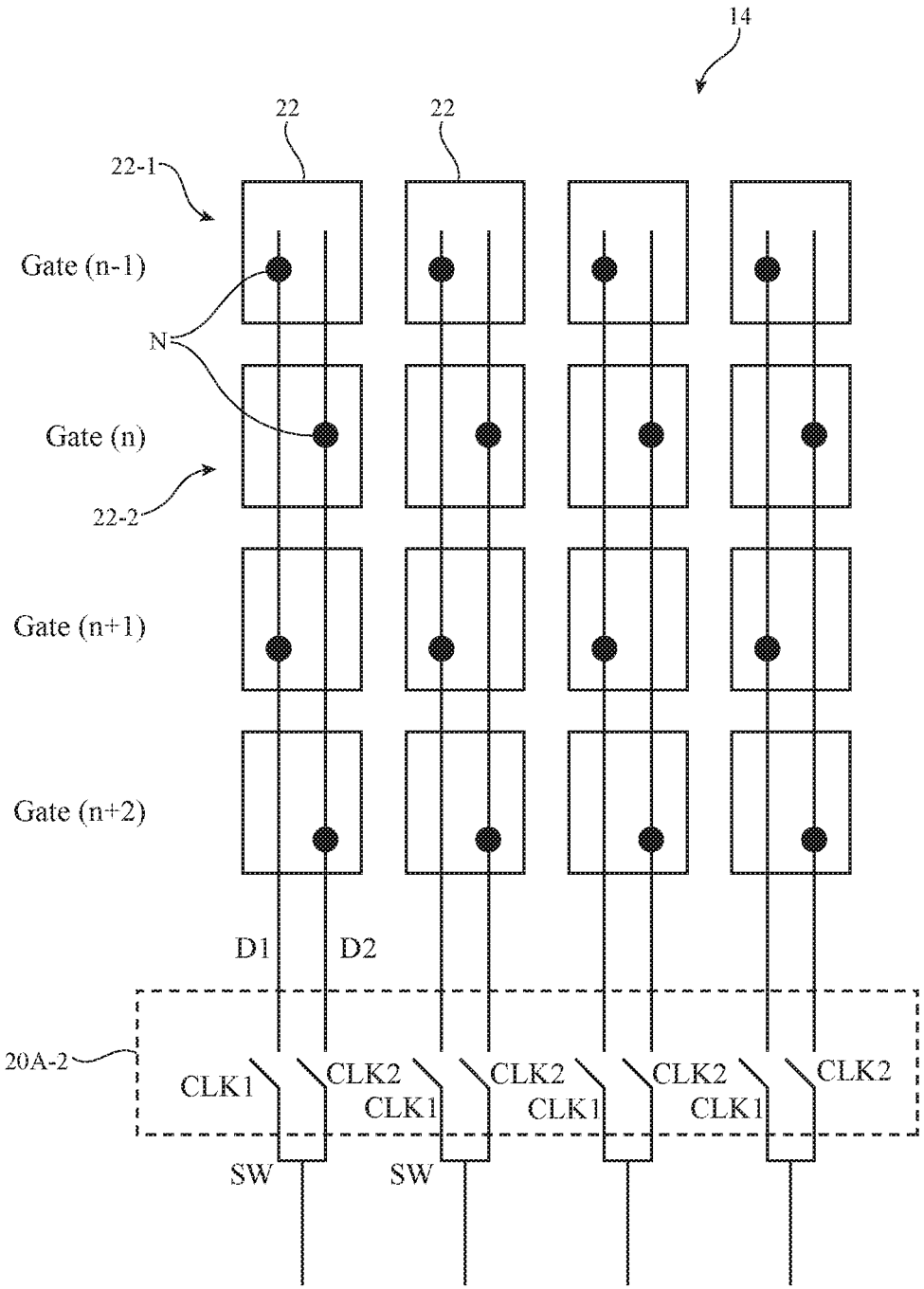
FIG. 3 is a circuit diagram of illustrative multiplexer and pixel circuitry in a display in accordance with an embodiment.
Figure 4:
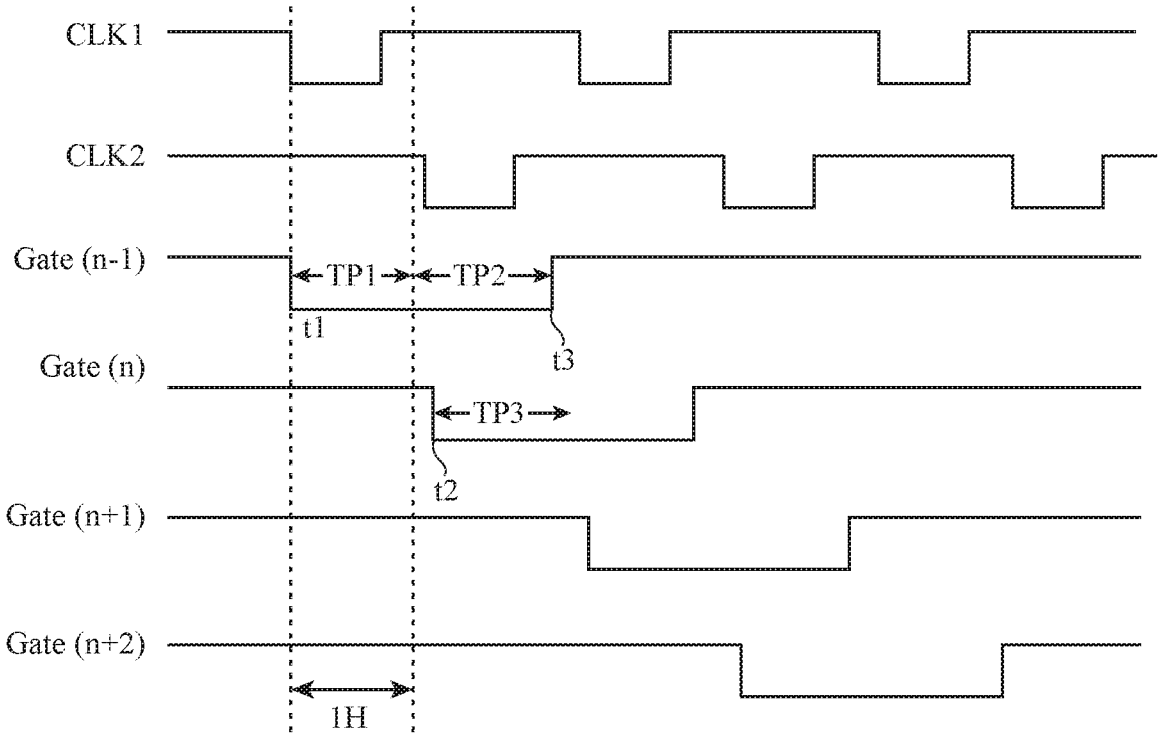
FIG. 4 is a timing diagram of illustrative control signals in a display in accordance with an embodiment.

In some configurations for display 14, each column of pixels 22 may include multiple data lines (e.g., at least two, at least three, etc.). An illustrative configuration for display 14 in which each column of pixels 22 include a pair of data lines D is shown in FIG. 3. A gate line may be associated with each row of pixels 22. Nodes N show where data lines D are coupled to the pixel circuits of pixels 22. Along each column, pixels are alternately coupled to odd and even data lines in each pair of data lines. As shown in FIG. 3, demultiplexer circuitry 20A-2 may contain switches SW that are controlled using control signals CLK1 and CLK2. FIG. 4 is a timing diagram showing signals that may be used in controlling display 14 of FIG. 3.

In high frame rate configurations for display 14, the row time ("1H" of FIG. 4) associated with controlling rows of pixels 22 tends to decrease. This can make it difficult to complete desired control operations (e.g., to load data into each row of pixels 22). By using multiple data lines per column of pixels 22, the control signals (e.g., the gate signals of FIG. 4) in successive rows can be staggered and can overlap in time, allowing each gate signal to be asserted for more than one row time (e.g., more than 1H). Consider, as an example, the loading of pixel 22-1 in row n-1 of FIG. 3 and the loading of pixel 22-2 in row n of FIG. 3. As shown in FIG. 4, gate signal gate(n-1) is taken low at time t1. Pixel 22-1 can then be loaded via data line D1. Loading can start during time period TP1 and can finish during time period TP2. At time t2, before the signal gate(n-1) is deasserted at time t3, gate signal gate(n) is asserted in row n. This allows pixel 22-2 to be loaded by data line D2. It is not necessary for gate signal gate(n-1) to complete before gate signal gate(n) is asserted, because pixel 22-1 is not coupled to data lines D2 (pixel 22-1 is coupled to data line D1 by a node N, but no nodes N couple pixel 22-1 to data line D2). As shown in FIG. 4, each gate signal may have a pulse width that is greater than the pulse widths of clocks CLK1 and CLK2.

Figure 5:
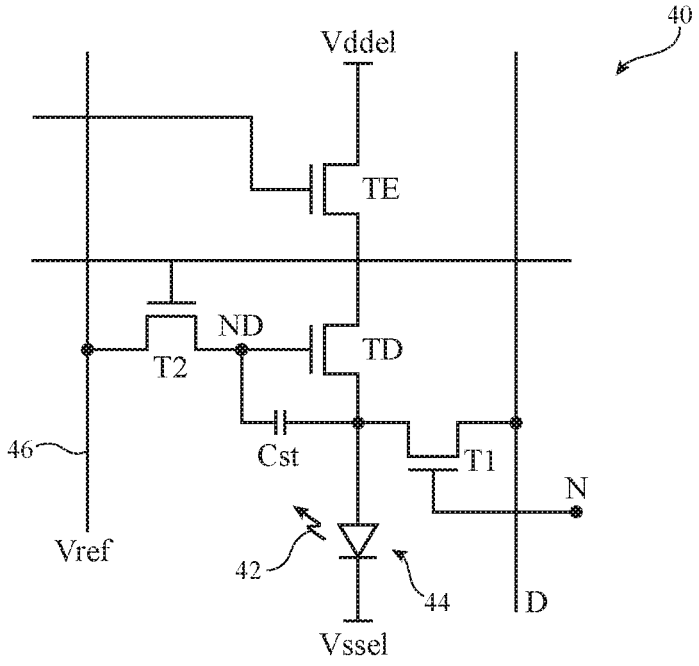
FIG. 5 is an illustrative pixel circuit in a display in accordance with an embodiment.

Any suitable pixel circuit may be used for forming pixels 22 in display 14. An illustrative pixel circuit is shown in FIG. 5. Other pixel circuitry may be used, if desired.

In the illustrative configuration of FIG. 5, pixel circuit 40 has switching transistors T1 and T2, drive transistor TD, and emission enable transistor TE. Transistors T1 and T2 are controlled by gate signals from gate driver circuitry 20B while data is provided via data line D. Storage capacitor Cst is used to retain data on node ND during emission operations. Reference voltage line Vref may be used in supplying a reference voltage Vref to pixel circuit 40. During sensing operations (for threshold voltage compensation measurements), data line D may be used to sense the current associated with the pixel. Drive transistor TD and enable transistor TE are coupled in series between positive power supply terminal Vddel and negative (ground) power supply terminal Vssel. When transistor TE is on, emission is enabled and the amount of light 42 that is emitted from light-emitting diode 48 is determined by the current flowing through transistor TD. This current is determined based on the magnitude of the signal on node ND, which is coupled to the gate of transistor TD.

Figure 6:
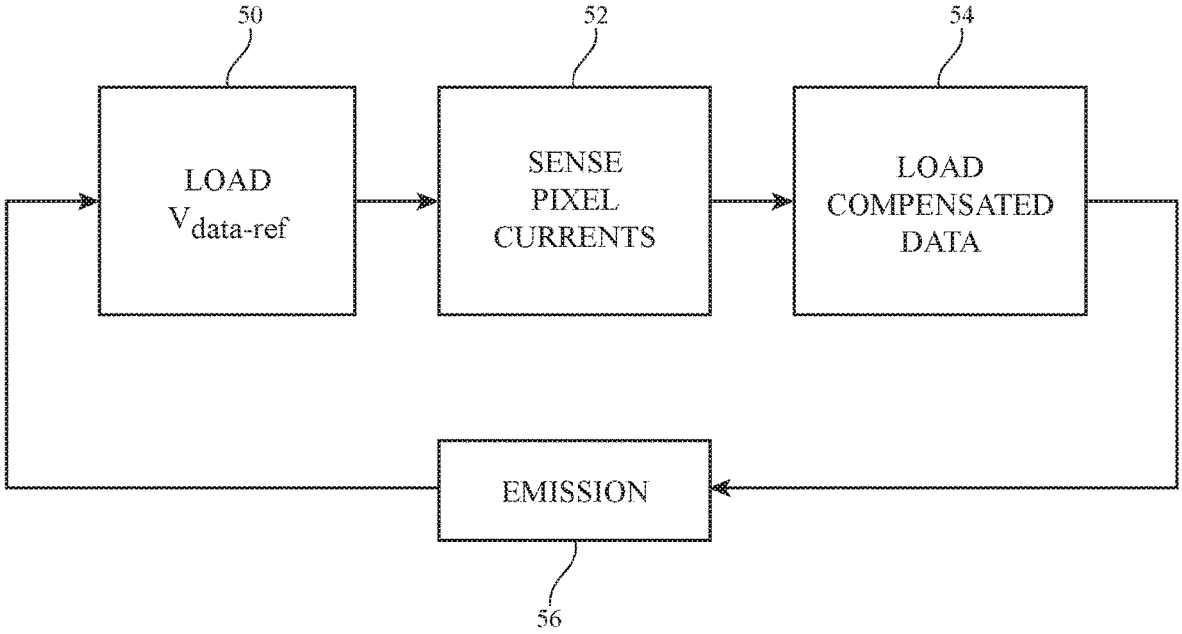
FIG. 6 is a flow chart of illustrative operations associated with operating a display in accordance with an embodiment.

A flow chart of illustrative operations involved in displaying an image frame using pixels 22 (e.g., pixels 22 with pixel circuit 40 of FIG. 5) is shown in FIG. 6. During the operations of block 50, transistors T1 and T2 are turned on and reference data Vdata-ref is loaded onto node ND. During the operations of block 52, sensors (e.g., current sensors) in circuitry 20A are used to sense pixel currents via data lines D. During pixel sensing operations, transistor T2 is turned off, transistor TE is turned on. Transistor T1 is on and allows the pixel current to flow through transistors TE and T1 to data line D for sensing. The sensed current is indicative of the threshold voltage of transistor TD. Following the sensing operations of block 52, a frame of corresponding pixel compensation values (e.g., digital values) can be produced by circuitry 20A. This frame of compensation data can be used to compensate an image frame for threshold voltage variations among pixels 22. The image frame (e.g., an image frame of data values for each pixel that have been compensated with the compensation data in the frame of compensation data) can be loaded into pixels 22 during the operations of block 54. During the operations of block 54, transistors T1 and T2 may be turned on for data loading while transistor TE is turned off. Compensated data is loaded into each pixel using data lines D. During the operations of block 56, transistors T1 and T2 are off and transistor TE is on to enable current to flow through light-emitting diode 44. The amount of current that flows through diode 44 and therefore the amount of light 42 that is emitted by diode 44 is determined by the current flowing through drive transistor TD, which is determined by the data on node ND.

Figure 7:
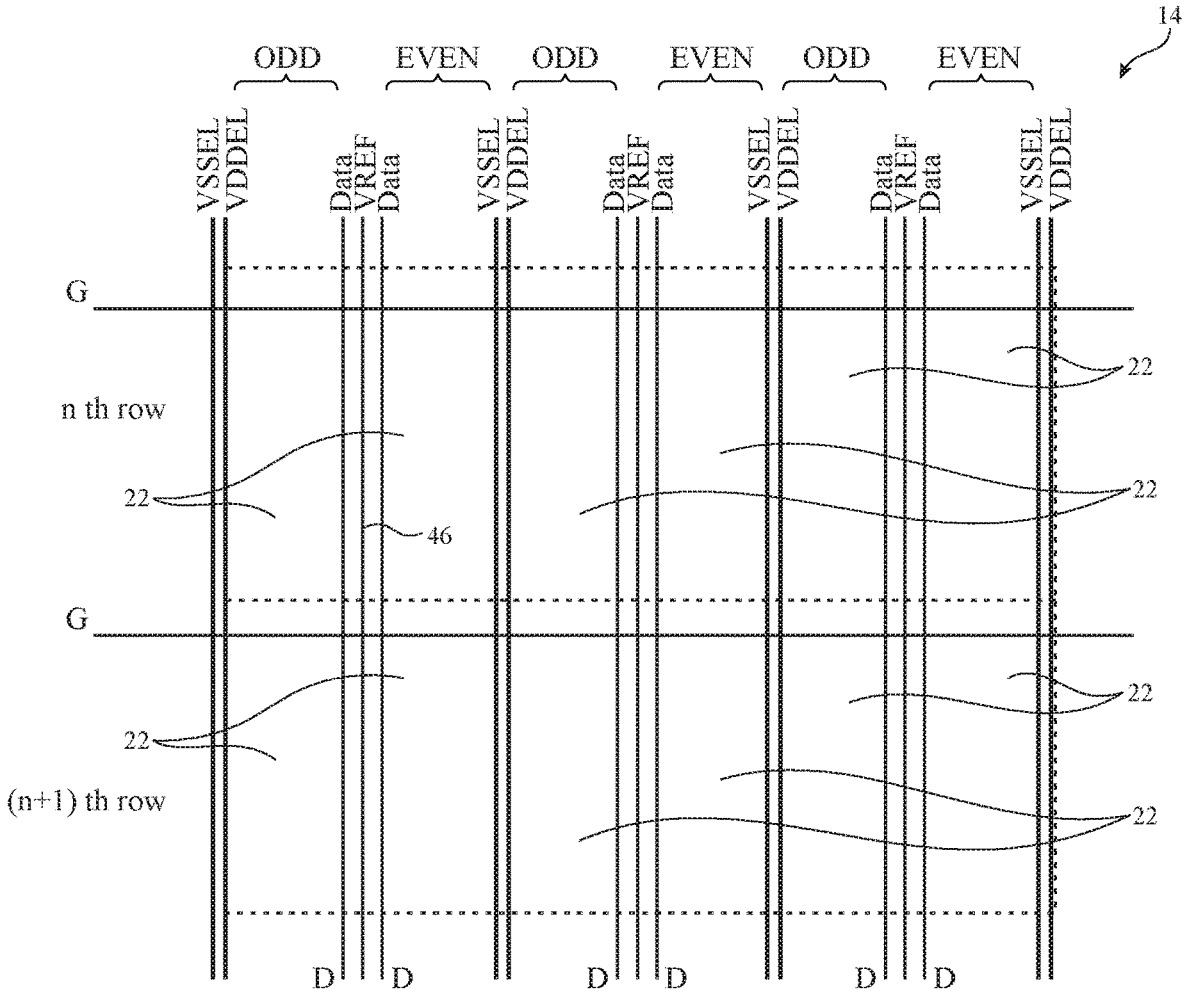
FIG. 7 is a top view of a portion of a display with power supply lines, data lines, and control lines in accordance with an embodiment.

FIG. 7 is a top view of a portion of display 14 showing an illustrative layout for power supply lines Vssel and Vddel and for reference line 46 and data lines DATA (sometimes referred to as data lines D). The illustrative layout of FIG. 8 allows each reference line 46 to be shared between an adjacent even column of pixels 22 and odd column of pixels 22 and allows each power supply line Vssel and each power supply line Vddel to be shared between adjacent even and odd columns of pixels 22. The layout of each pixel circuit 40 in each even column may have mirror symmetry with the layout of each pixel circuit 40 in an adjacent odd column. Data lines DATA may extend vertically through pixels 22 in pairs. Each pair of data lines may include a first data line for loading data into an odd column of pixels 22 and a second data line for loading data into an even column of pixels 22.

Figure 8:
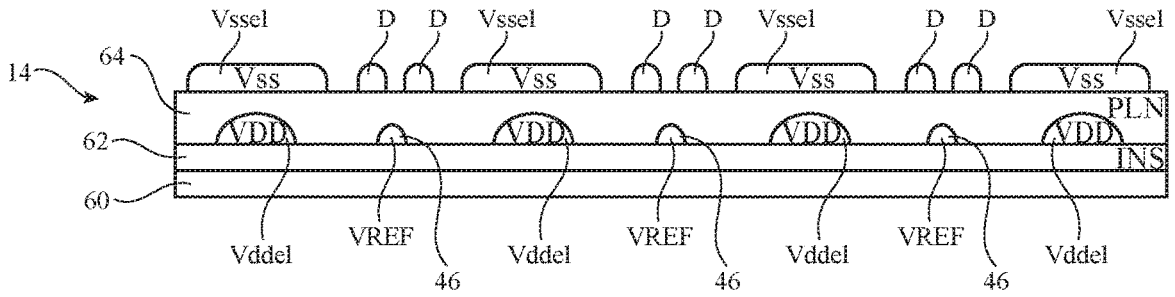
FIG. 8 is a cross-sectional side view of an illustrative display in accordance with an embodiment.
Figure 14:
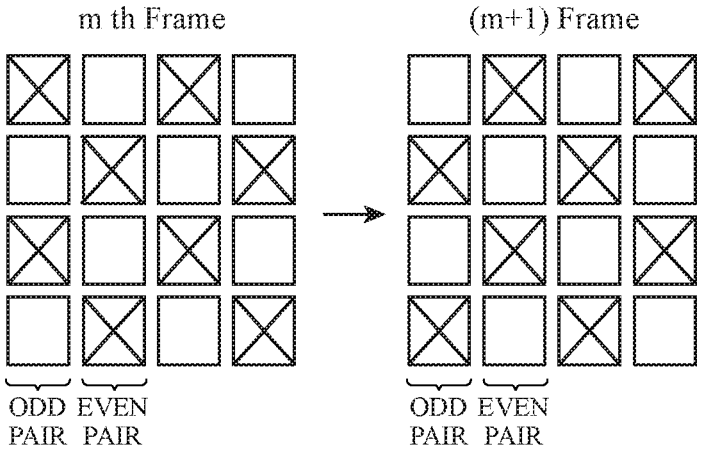
FIG. 14 is a diagram corresponding to pixel loading patterns in successive frames using the signals of FIG. 13 in accordance with an embodiment.

A cross-sectional side view of display 14 of FIG. 14 is shown in FIG. 8. As shown in FIG. 8, dielectric layer 62 may be formed on lower thin-film transistor circuitry layers, a substrate layer and/or other layers (see, e.g., layer 60). Power supply lines Vddel and reference lines 46 may be formed on layer 62. Planarization layer 64 may cover these lines and layer 62. Power supply lines Vssel and data lines D (e.g., data lines running parallel to each other in pairs) may be formed on layer 64.

In configurations for display 14 with mirror symmetry pixel layouts and pairs of data lines of the type shown in FIGS. 7 and 8, the space consumed by signal lines can be reduced by consolidating signal lines such as the power supply lines and reference voltage lines. However, parasitic capacitances between adjacent data lines D in each pair of data lines may arise (see, e.g., parasitic capacitances Cp of FIG. 9). If care is not taken (e.g., if odd and even columns of pixels are loaded separately), there is a potential for capacitive coupling between the even column data lines and the odd column data lines to adversely affect the accuracy of loaded data.

To address this concern, data can be driven onto the data lines of each pair of data lines simultaneously. Demultiplexing circuitry 20A-2 may be used to reduce fanout between circuit 20A-1 and data lines D. To accommodate the use of demultiplexing circuitry 20A-2 in a configuration for display 14 with pairs of simultaneously driven data lines, demultiplexing circuitry 20A-2 can alternate between a first state in which odd pairs of columns are loaded and a second state in which even pairs of columns are loaded.

Figure 9:
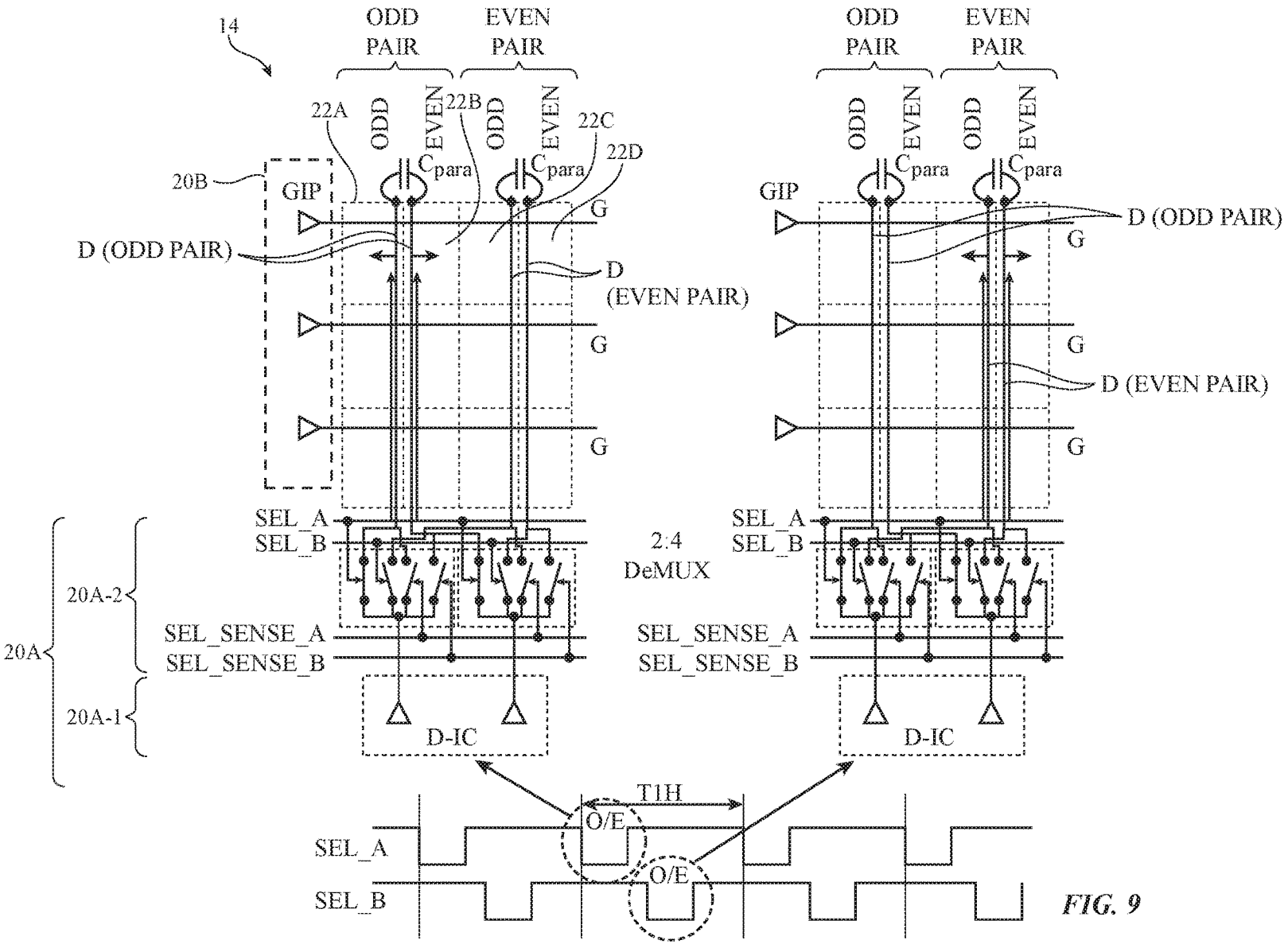
FIG. 9 is a diagram showing how display demultiplexer circuitry may be operated during data loading in accordance with an embodiment.

This type of arrangement is shown in FIG. 9. As shown in FIG. 9, demultiplexing circuitry 20A-2 may be dynamically configured in accordance with control signals (sometimes referred to as clock signals CLK1 and CLK2) such as SEL_A and SEL_B. When SEL_A is taken low, data is loaded from demultiplexer circuitry 20A-2 into odd pairs of columns and when SEL_B is taken low data is loaded into even pairs of columns. For example, when SEL_A is taken low, data is located into pixels 22A and 22B of each odd column pair using data lines D(ODD PAIR) and when SEL_B is taken low, data is located into pixels 22C and 22D of each even column pair using data lines D(EVEN PAIR). The alternating column pair loading pattern used in FIG. 9, which may be used during the operations of blocks 50 and 54 of FIG. 6, may help enhance data loading accuracy.

Figure 10:
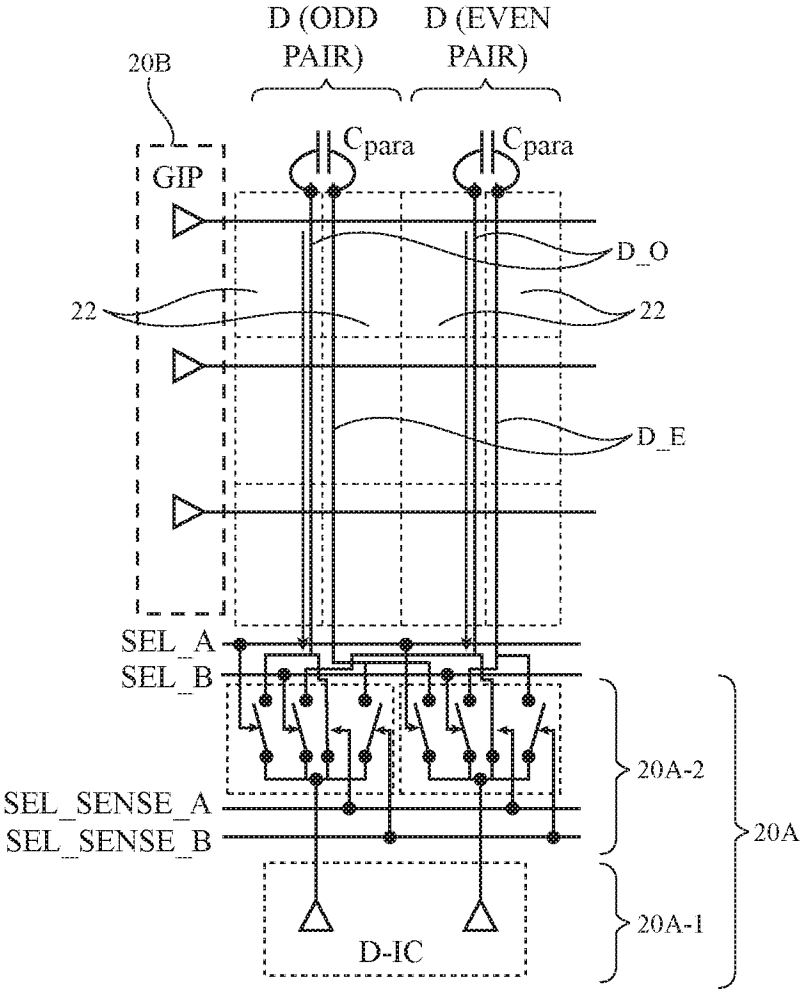
FIG. 10 is a diagram showing how display demultiplexer circuitry may be operated during current sensing operations in accordance with an embodiment.

As shown in FIG. 10, pixel sensing (e.g., sensing operations to measure currents for threshold voltage compensation during the operations of block 52 of FIG. 6), may use a different pattern of data lines. In particular, during sensing operations, demultiplexer circuitry 20A may be configured to alternate between a first state in which first and second odd data lines D_O from first and second adjacent column pairs (e.g., ODD PAIR and EVEN PAIR) are used to provide current measurements to circuitry 20A-1 and a second state in which first and second even data lines D_E from the first and second adjacent columns pairs are switched into use for current sensing. Differential current sensing may be used to mitigate the impact of potential fabrication variations (e.g., variations that might make the capacitive coupling different between a gate line G and a first data line relative to the capacitive coupling between that gate line and a second data line that is paired with the first data line). The use of differential sensing may help remove common mode noise from horizontal lines such as gate lines G that overlap the data lines.

Figure 11:
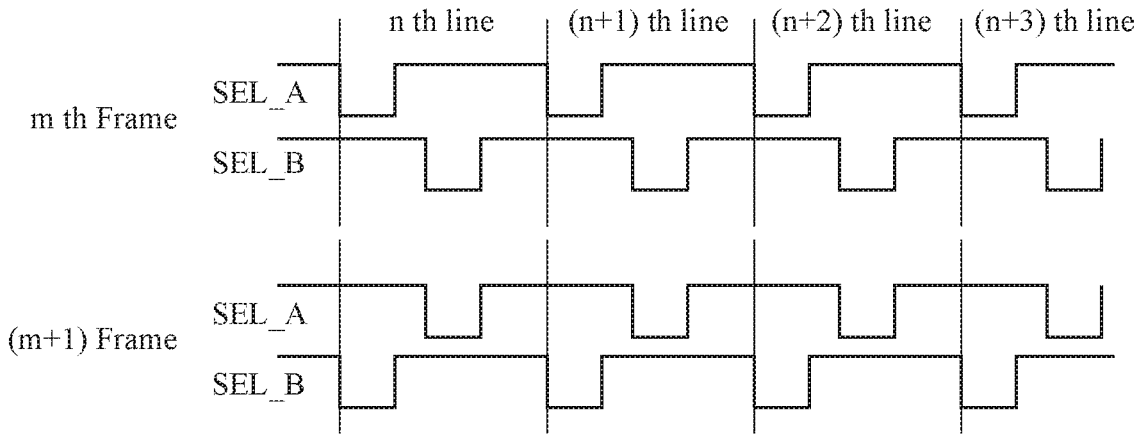
FIG. 11 is a timing diagram of illustrative data loading control signals for two successive frames in accordance with an embodiment.
Figure 12:
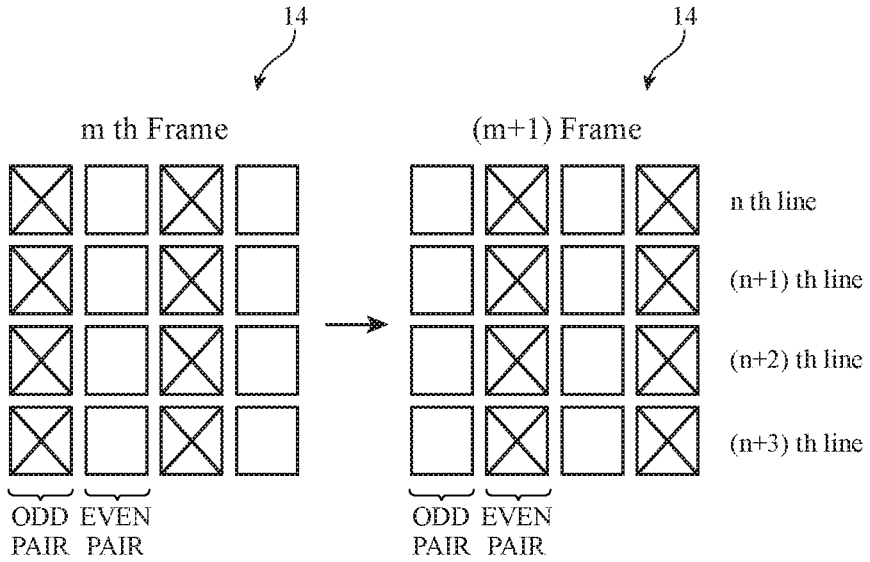
FIG. 12 is a diagram corresponding to pixel loading patterns in successive frames using the signals of FIG. 11 in accordance with an embodiment.
Figure 13:
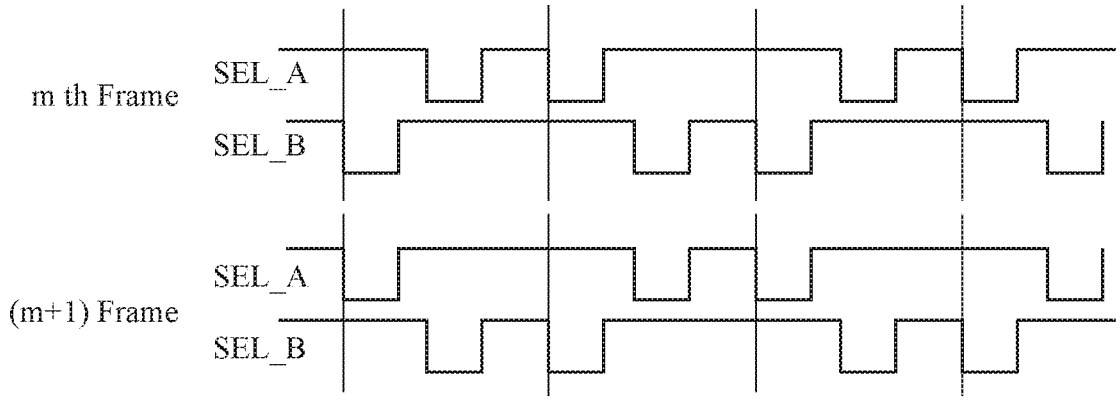
FIG. 13 is a timing diagram of additional illustrative data loading control signals for two successive frames in accordance with an embodiment.

The patterns used for loading and sensing may, if desired, vary between frames. As shown in the timing diagram of FIG. 11 and the corresponding pixel loading patterns for frames m and m+1 in FIG. 12, for example, the column pairs that are loaded may vary between frames. In frame m, odd column pairs may be loaded. In frame m+1, even column pairs may be loaded. This alternating pattern can help reduce artifacts from capacitive coupling between adjacent pairs of columns (and associated adjacent pairs of data lines). FIGS. 13 and 14 show an arrangement in which both column pair and row alternations are used (e.g., to form an alternating checkerboard pattern of loaded sets of pixels between respective frames). Other time varying patterns may be used, if desired.

Figure 15:
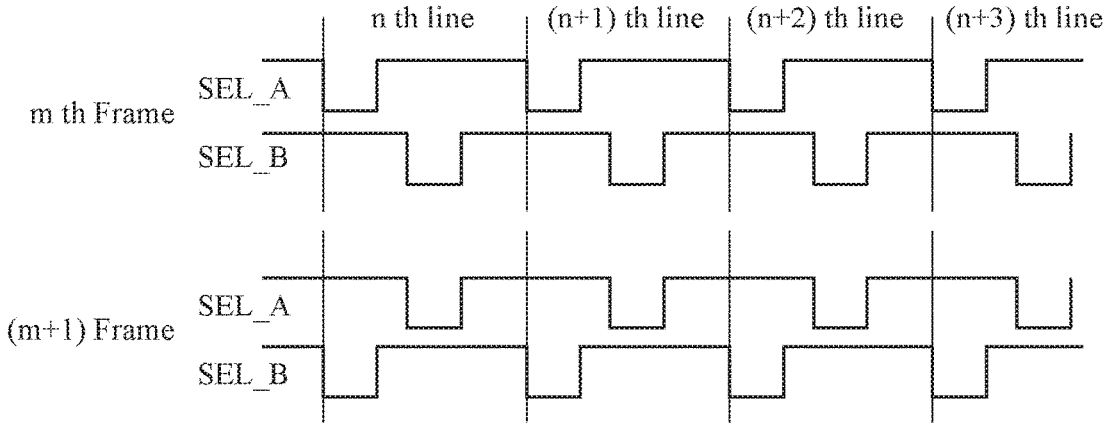
FIG. 15 is a timing diagram of illustrative current sensing control signals for two successive frames in accordance with an embodiment.
Figure 16:
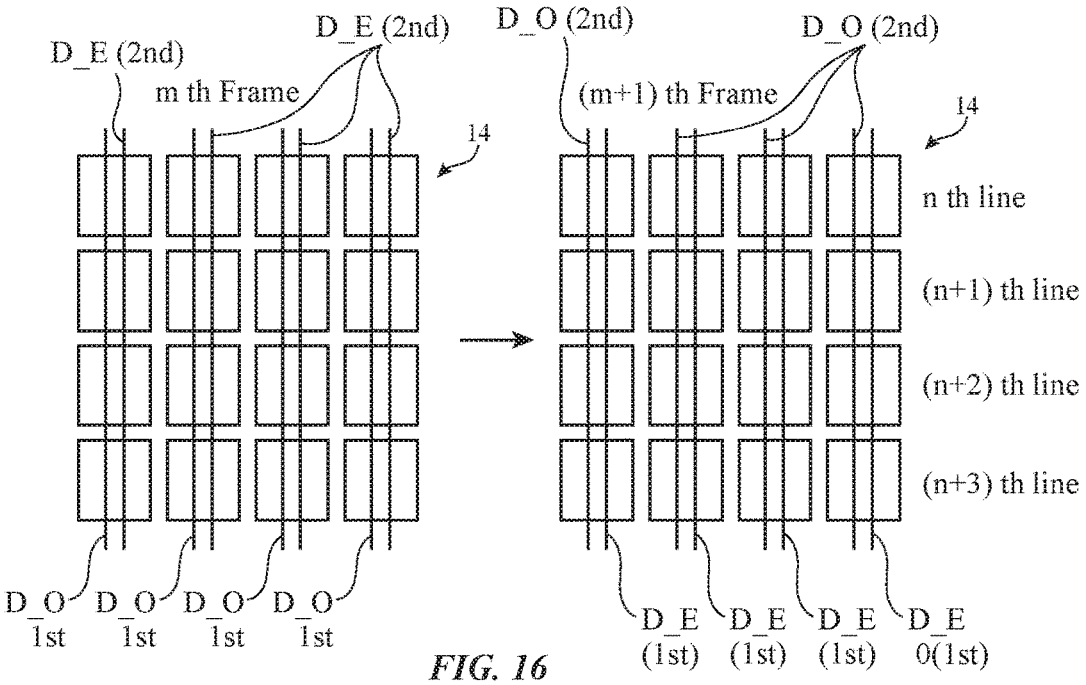
FIG. 16 is a diagram corresponding to pixels being sensed during the successive frames of FIG. 15 in accordance with an embodiment.

An illustrative arrangement for varying the pattern of data lines used during sensing between successive frames is shown in the timing diagram of FIG. 15 and the corresponding pixel and data line diagrams for frames m and m+1 in FIG. 16. As shown in FIGS. 15 and 16, in the mth frame, odd data lines D_O (e.g., pairs of lines for differential sensing) may be switched into use before switching even data lines D_E into use. In the m+1$^{st}$ frame, this pattern is reversed and even data lines D_E are used before odd data lines D_O.

Figure 17:
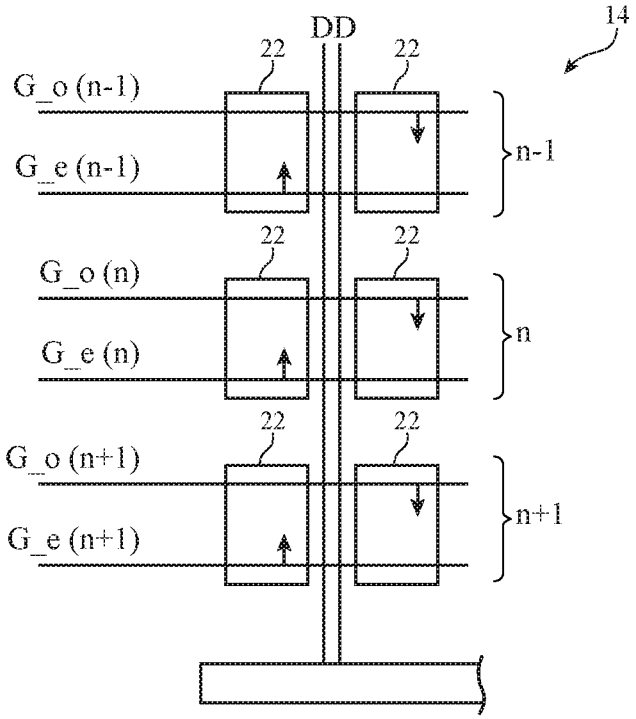
FIG. 17 is a diagram of illustrative pixels in a display in accordance with an embodiment.
Figure 18:
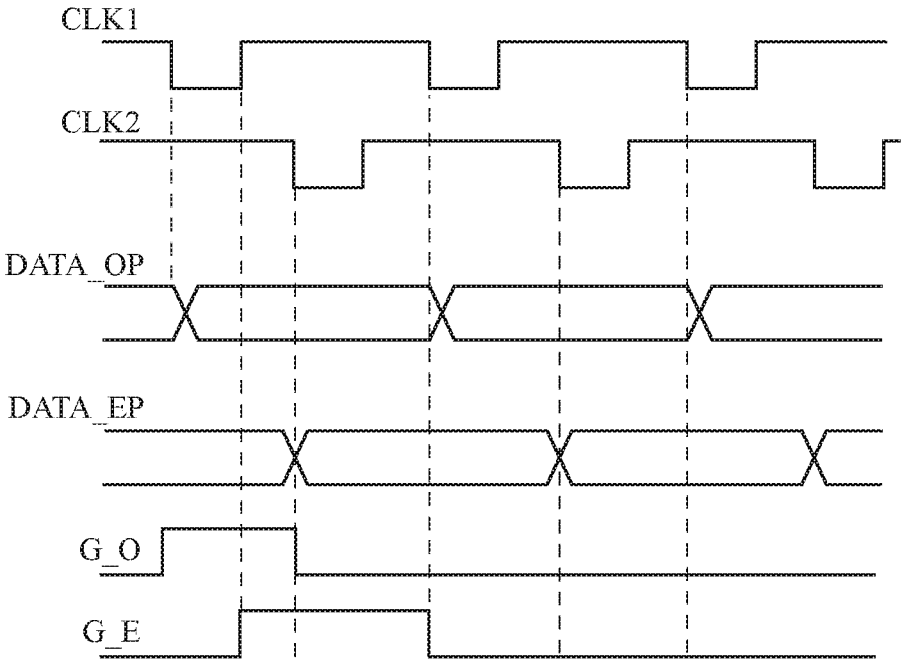
FIG. 18 is a timing diagram of illustrative control signals for operating the circuitry of FIG. 17 in accordance with an embodiment.

An alternative configuration for loading pixels 22 is shown in the pixel diagram of FIG. 17 and the corresponding timing diagram of FIG. 18. In this arrangement, each row of pixels 22 shares two gate lines (or sets of gate lines) such as odd gate lines G_O and even gate lines G_E. When CLK1 is asserted (e.g., taken low), odd pairs of columns are selected by demultiplexer circuitry 20A-2. When CLK2 is asserted (e.g., taken low), even pairs of columns are selected. Gate signals on odd lines G_O are asserted and deasserted in accordance with the falling edges of CLK1 and CLK2, respectively. Gate signals on even lines G_E are asserted and deasserted in accordance with the falling edges of CLK2 and CLK1, respectively. During the period of time in which each pair of data lines is loaded with data, first the odd gate line and then the even gate line is asserted, thereby loading the left-hand pixel 22 and then the right-hand pixel associated with that pair of data lines.

Figure 19:
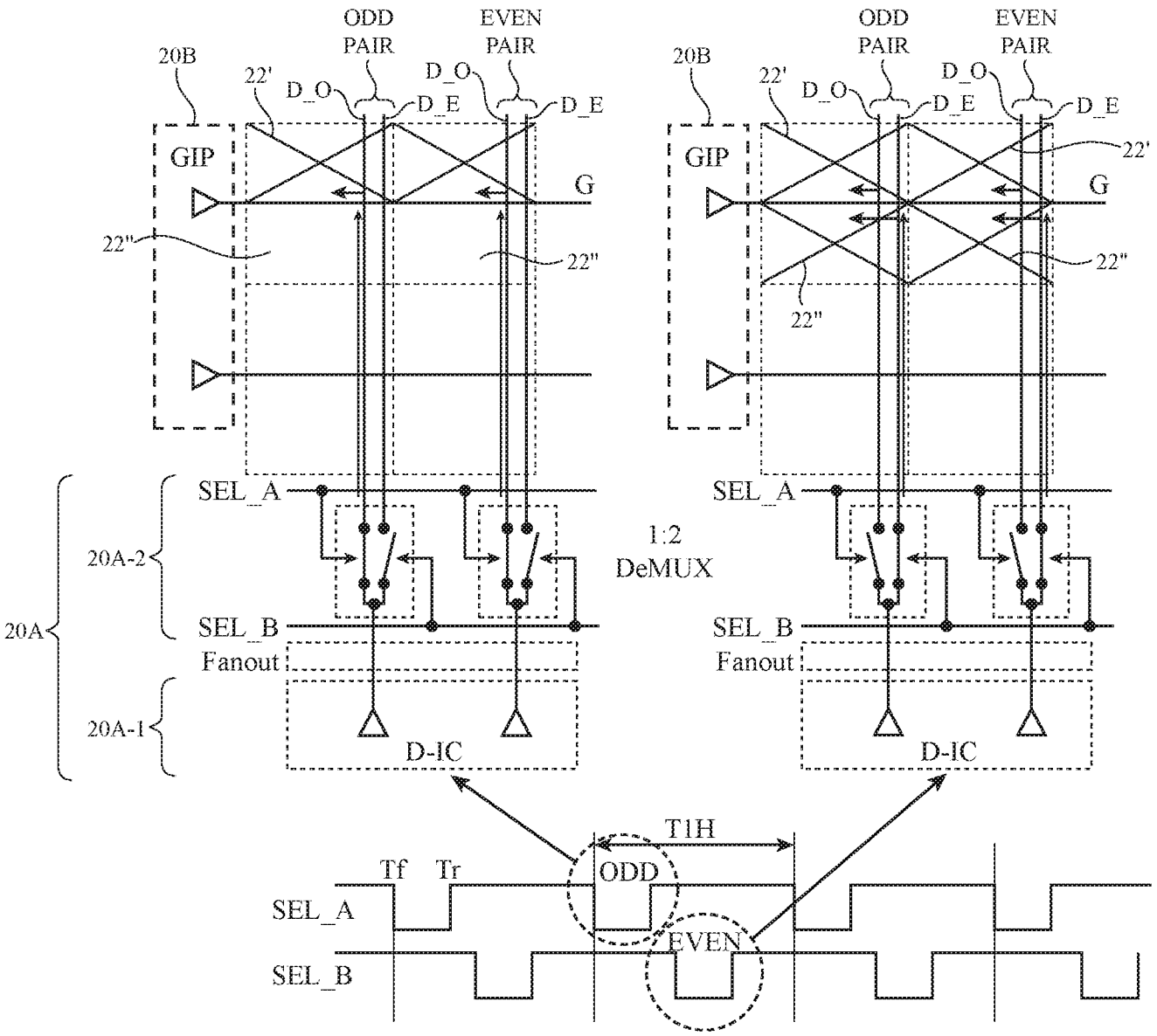
FIGS. 19, 20, and 21 illustrate data loading operations in accordance with embodiments.
Figure 20:
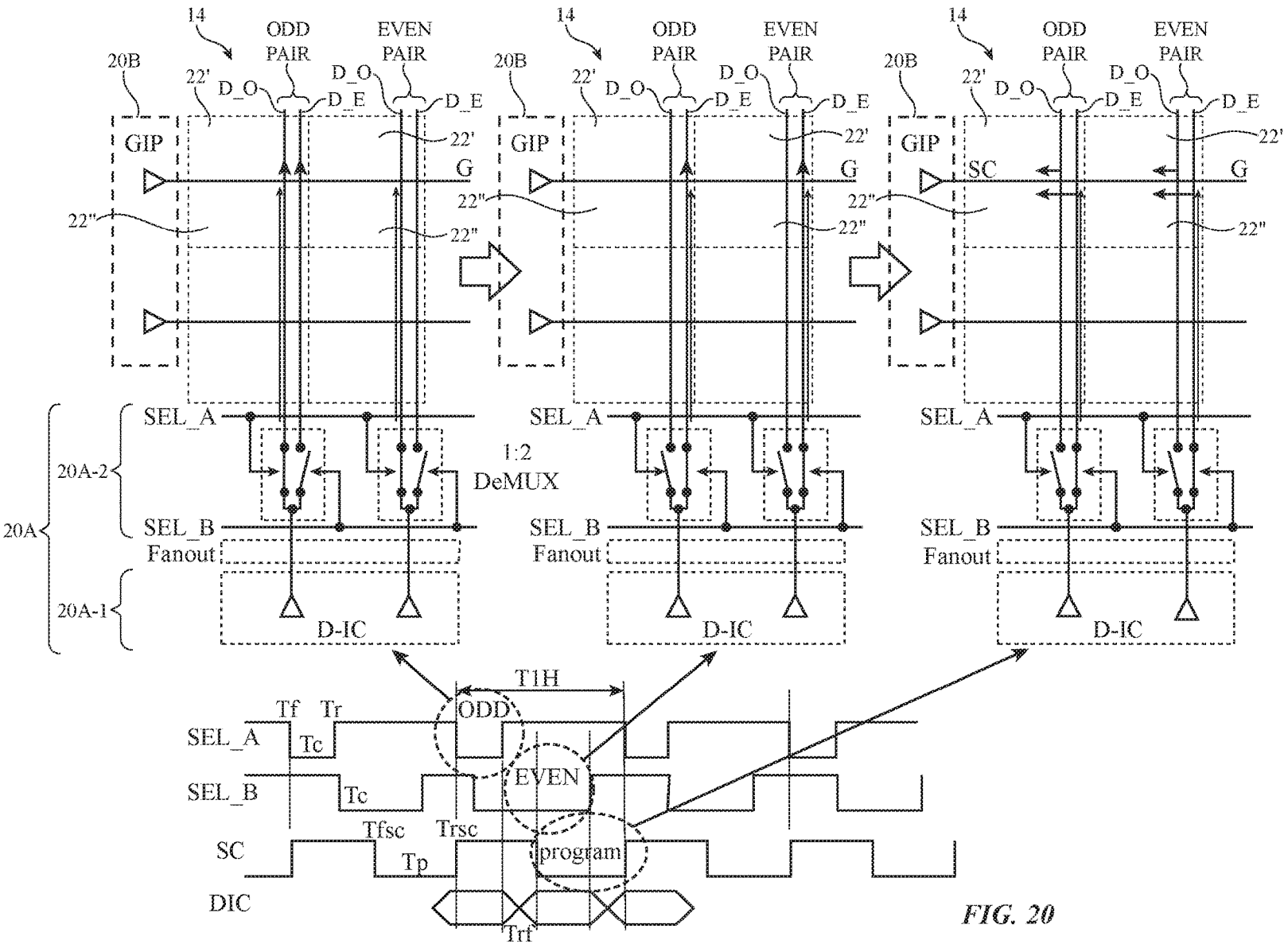
Figure 22:
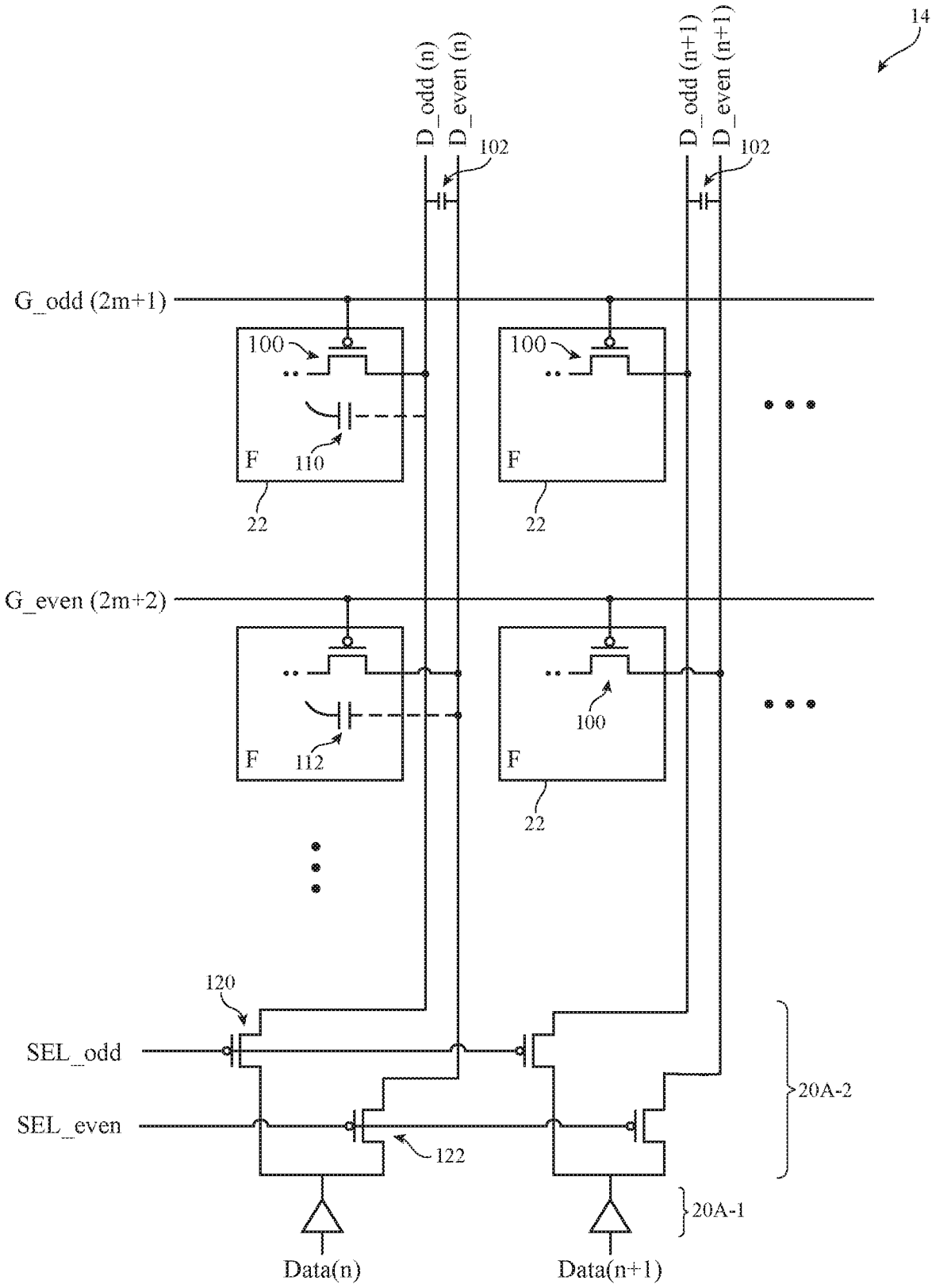
FIG. 22 is a diagram showing how an array of display pixels can be affected by vertical crosstalk and a difference in row-to-row parasitic capacitance.

FIGS. 19, 20, and 22 show additional illustrative arrangements for loading pixels 22 in display 14. In the configuration of FIG. 19, a gate line G in a given row is asserted while (in a first demultiplexer state) odd date lines D_O are used in providing data to a first row of pixels 22' that are associated with the asserted gate line G and (in a second demultiplexer state) even data lines D_E are used in providing data to a second row of pixels 22" that are associated with the asserted gate line G.

FIG. 20 shows an illustrative configuration in which (1) odd date lines D_O are provided with data and are then left floating, (2) even data lines D_E are provided with data and are then left floating, and (3) gate control signal SC is asserted on a gate line G to load data from the odd data lines into a first row of pixels 22' associated with the gate line and to load data from the even data lines into a second row of pixels 22" associated with the gate line.

Figure 21:
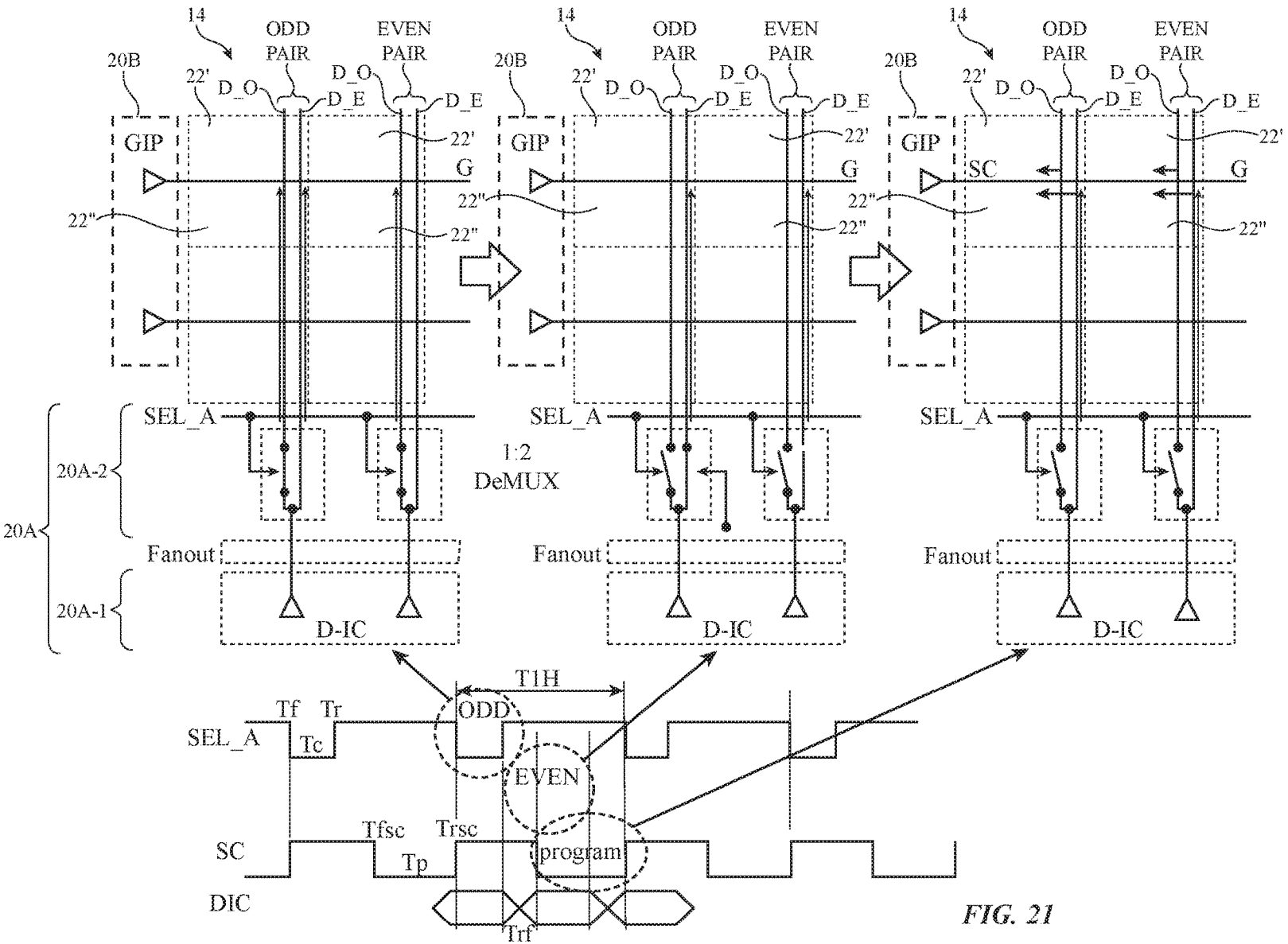

FIG. 21 shows an illustrative configuration in which demultiplexer 20A-2 uses 1:2 demultiplexer circuits. Demultiplexer 20A-2 first provides odd data lines D_O with data while both the odd and even lines are coupled to the input of each 1:2 demultiplexer. After switching the state of demultiplexer 20A-2, data is provided to even data lines D_E. After loading the odd and even data lines with data in this way, the pixels are loaded (programmed). During programing, gate line G supplies signal SC (signal SC is taken low) and a first row of pixels 22' associated with the gate line G is loaded with data from the odd data lines D_O while a second row of pixels 22" is loaded with data from the even data lines D_E.

The use of odd and even data lines in each column of display pixels may give rise to vertical column crosstalk between the odd and even data lines (see FIG. 22). As shown in FIG. 22, a first row (i.e., odd row "2m+1") includes a row of pixels 22 each having a p-type data loading transistor 100 having a source-drain terminal connected to the odd data line D_odd and a gate terminal that receives gate line signal G_odd(2m+1). Data loading transistor 100 is similar to transistor T1 in the exemplary pixel structure of FIG. 5, which is used to load in a data signal during the data programming phase. Similarly, a second row (i.e., even row "2m+2") includes a row of pixels 22 each having a p-type data loading transistor 100 having a source-drain terminal connected to the even data line D_even and a gate terminal that receives gate line signal G_even(2m+2). The gate line signals are sometimes referred to as "scan" signals. Other rows within display 14 may be formed in this alternating fashion in which the odd rows are connected to the odd data lines D_odd and the even rows are connected to the even data lines D_even. All pixels 22 in the arrangement of FIG. 22 are formed in the same orientation, as indicated by the imaginary notation "F" at the corner of each pixel 22.

The odd data lines receive corresponding data signals through p-type selection transistor 120 within demultiplexer 20A-2, whereas the even data lines receives corresponding data signals through p-type selection transistor 122 within demultiplexer 20A-2. Transistors 120 receive a selection control signal SEL_odd, which is driven low to pass data signal Data(n) in the first column to data line D_odd(n) and to pass data signal Data(n+1) in the second column to data line D_odd(n+1). Similarly, transistors 122 receive a selection control signal SEL_even, which is driven low to pass data signal Data(n) in the first column to data line D_even(n) and to pass data signal Data(n+1) in the second column to data line D_even(n+1).

Figure 23:
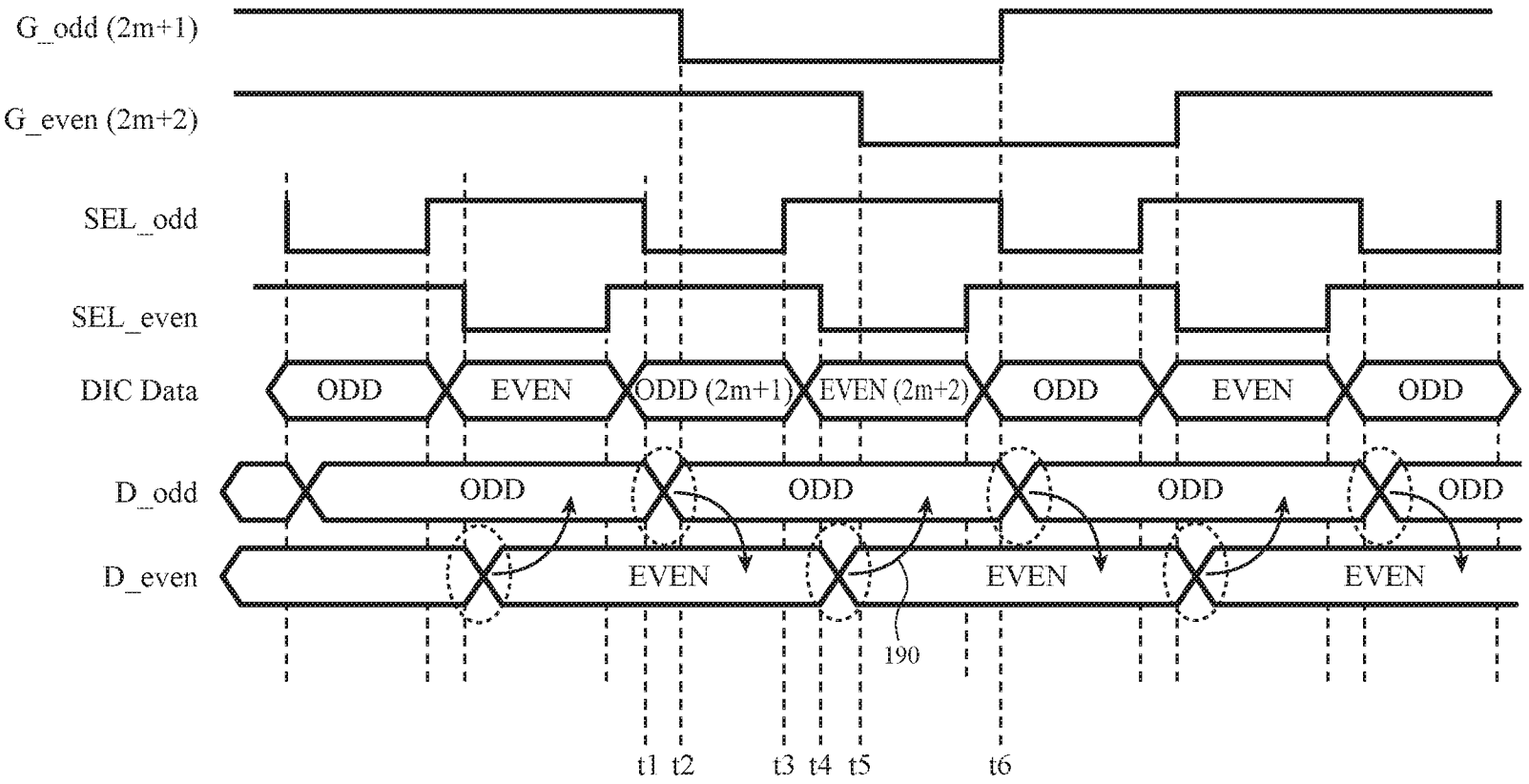
FIG. 23 is a timing diagram illustrating how vertical crosstalk between odd and even rows can affect data accuracy.

One potential problem with the display configuration of FIG. 22 is that due to the formation of the odd and even data lines right next to each other, a relatively large parasitic coupling capacitance 102 exists between each pair of adjacent data lines D_odd and D_even. A large parasitic coupling capacitance 102 may induce vertical data line crosstalk, which can degrade the accuracy of data signals being loaded into the pixel array. This undesired effect is shown in the timing diagram of FIG. 23. At time t1, signal SEL_odd is driven low to pass display driver circuit ("DIC") data for row "2m+1" onto corresponding data lines D_odd. At time t2, gate line signal G_odd(2m+1) is driven low to turn on data loading transistors 100 to pass the data signals from the odd data lines onto row "2m+1".

At time t3, signal SEL_odd is driven high, which allows data lines D_odd to float. Thus, between time t2 and t3, data lines D_odd are actively driven, but data lines D_odd will be in a high impedance state after SEL_odd is driven high. At time t4, signal SEL_even is driven low to pass display driver circuit data for row "2m+2" onto corresponding data lines D_even. When the voltage on D_even changes at this point, the large parasitic data line capacitance 102 will cause any voltage perturbation on D_even to be coupled onto D_odd, as shown by arrow 190, especially since D_odd is in high impedance state during this time. Since the data loading transistors in row "2m+1" is still on, data kicking in this way can negatively impact data driving accuracy. At time t5, gate line signal G_odd(2m+2) is driven low to turn on data loading transistors 100 to pass the data signals from the even data lines onto row "2m+2". At time t6, gate line signal G_odd(2m+1) is driven high to turn off the data loading transistors 100. The vertical crosstalk may cause data kicking in every clock cycle whenever new data is first driven onto data line D_odd while D_even is floating or vice versa.

The pixel configuration of FIG. 22 can also suffer from another problem where odd and even rows have different parasitic capacitances to the corresponding data lines. As shown in FIG. 22, pixels 22 in the first row have internal nodes that are coupled to data line D_odd via parasitic capacitance 110, whereas pixels 22 in the second row have internal nodes that are coupled to data line D_even via parasitic capacitance 112. Because D_even is farther from the pixel than D_even as shown in the example of FIG. 22, parasitic capacitance 110 will be necessarily different than parasitic capacitance 112. This difference in parasitic capacitance between rows can result in content-dependent non-uniformity between rows, another undesired effect.

Figure 24:
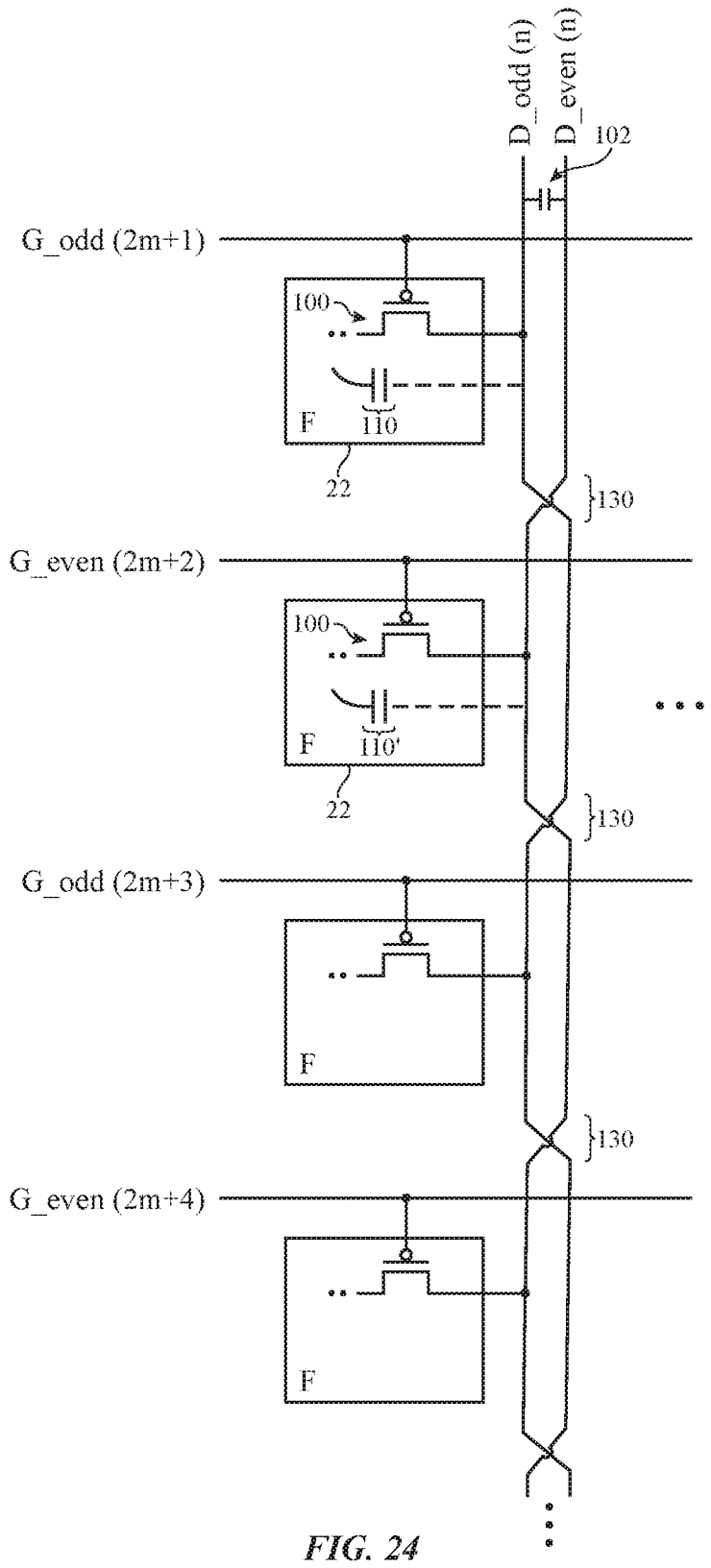
FIG. 24 is a diagram showing how the odd and even data lines may be interlaced to help mitigate the difference in row-to-row parasitic capacitance in accordance with an embodiment.

In accordance with an embodiment, FIG. 24 is a diagram showing how the odd and even data lines may be intertwined to help mitigate the difference in row-to-row parasitic capacitance. As shown in FIG. 24, data lines D_odd and D_even are braided and alternate position between successive rows (as shown by crossover region 130), which allow data line D_odd to be closer to the pixels 22 in the odd rows "2m+1" and "2m+3" and allow data line D_even to be closer to the pixels 22 in even rows "2m+2" and "2m+4". Arranged in this way, pixels 22 in the odd rows have internal nodes that are coupled to data line D_odd via parasitic capacitance 110, and pixels 22 in the even rows have internal nodes that are coupled to data line D_even via parasitic capacitance 110', which is identical to that of parasitic capacitance 110. Because parasitic capacitance 110 is substantially equivalent to parasitic capacitance 110', any row-to-row difference is eliminated, thereby solving the content-dependent non-uniformity problem between odd and even rows.

Figure 25:
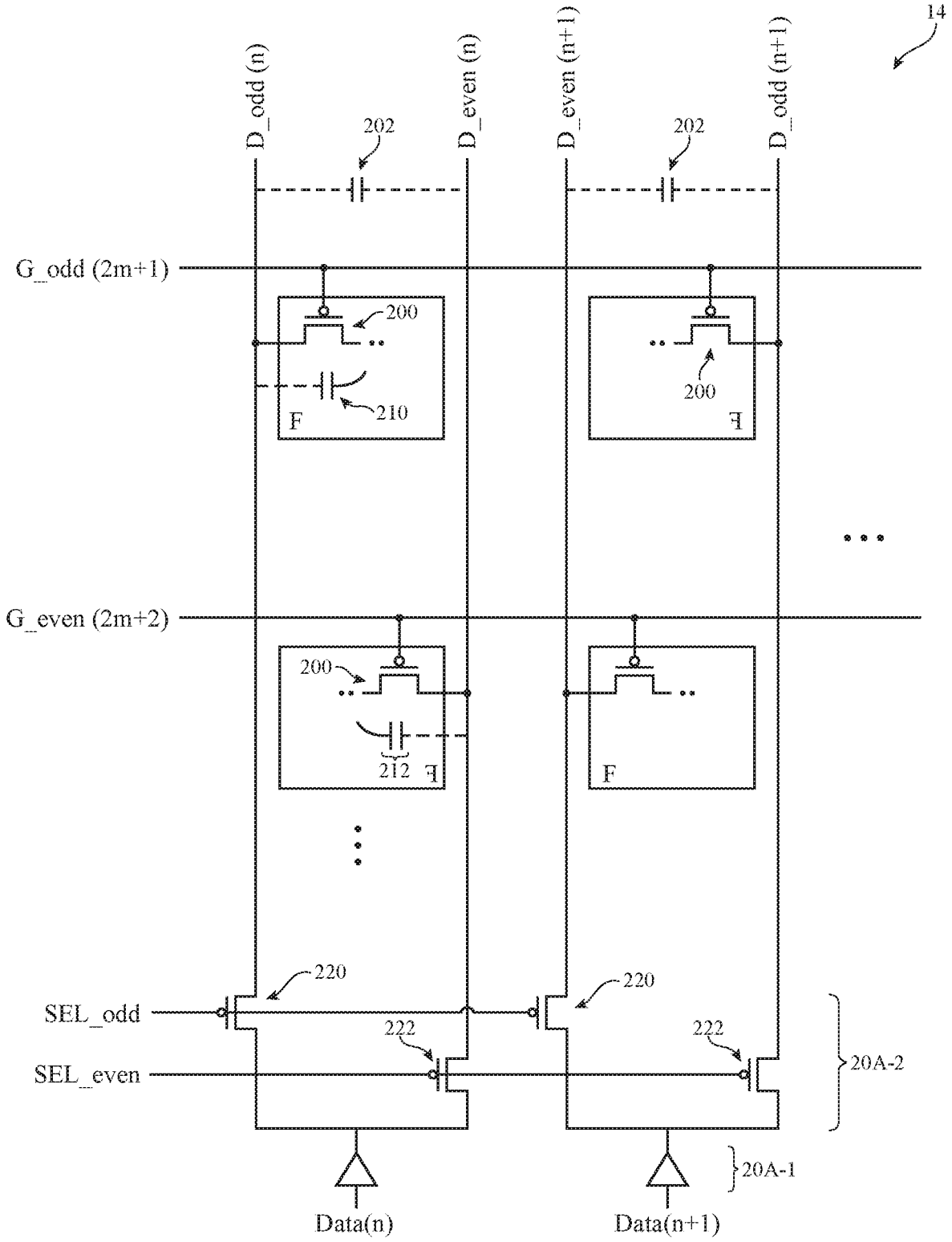
FIG. 25 is a diagram showing an illustrative array of display pixels where vertical crosstalk and any difference in row-to-row parasitic capacitance are minimized in accordance with an embodiment.

FIG. 25 is a diagram showing an illustrative array of display pixels where vertical crosstalk and any difference in row-to-row parasitic capacitance are both minimized in accordance with an embodiment. As shown in FIG. 25, a first row (e.g., odd row "2m+1") may include a row of pixels 22 each having a p-type data loading transistor 200 having a source-drain terminal coupled to the odd data line D_odd and a gate terminal that receives gate line signal G_odd (2m+1). Note that data line D_odd is formed to the left of pixel 22. Transistor 200 may be similar to transistor T1 in the exemplary pixel structure of FIG. 5 or can generally represent any data loading transistor configured to load data signals during the data programming phase.

In contrast, a second row (i.e., even row "2m+2") may include a row of pixels 22 each having a p-type data loading transistor 200 having a source-drain terminal coupled to the even data line D_even and a gate terminal that receives gate line signal G_even(2m+2). Note that data line D_even is formed to the right of pixel 22. The gate line signals are sometimes referred to as scan signals, scan line signals, scan control signals, row control signals, etc. Other rows within display 14 may be formed in this alternating fashion in which the odd rows are connected to the odd data lines D_odd formed on one side of the pixel, whereas the even rows are connected to the even data lines D_even formed on the other side of the pixel.

The odd data lines may receive corresponding data signals from a first data driver circuit through p-type selection transistor 220 within demultiplexer 20A-2, whereas the even data lines may receive corresponding data signals from a second data driver circuit through p-type selection transistor 222 within demultiplexer 20A-2. Transistors 220 may receive a selection control signal SEL_odd, which is asserted (e.g., driven low) to pass data signal Data(n) from the first data driver circuit in the first column to data line D_odd(n) and to pass data signal Data(n+1) from the second data driver circuit in the second column to data line D_odd (n+1). Similarly, transistors 222 may receive a selection control signal SEL_even, which can be asserted (e.g., driven low) to pass data signal Data(n) in the first column to data line D_even(n) and to pass data signal Data(n+1) in the second column to data line D_even(n+1).

In contrast to the arrangement of FIG. 22, pixels 22 in the example of FIG. 25 are not all formed in the same orientation. As shown by the imaginary notation "F" at the corner of each pixel 22, the pixels in different rows are vertically mirrored with respect to each other. This presents a more efficient layout because data loading transistor 200 is coupled to data line D_odd to the left in the odd rows, whereas data loading transistor 200 is coupled to data line D_even to the right in the even rows. This example in which the odd data lines are formed to the left and the even data lines are formed to the right of each pixel is merely illustrative. If desired, the odd data liens maybe formed to the right while the even data liens are formed to the left of each pixel. Moreover, adjacent columns may also be mirrored with respect to one another. Mirrored in this way, the even data lines from adjacent columns will be placed next to one another (e.g., data line D_even(n) is placed next to data line D_even(n+1), etc.). The rest of the array may be formed by replicating the two columns shown in FIG. 25.

Configured in this way, the odd and even data lines of each column are placed far from any other data line that can potentially impact the data loading accuracy. By placing data lines D_odd and D_even on either side of pixel 22, the parasitic capacitance 202 even the odd and even data line pair is much lower than that of capacitance 102 (see FIG. 22) and thus vertical cross is substantially mitigated. The fact that the even data lines between adjacent columns or that the odd data lines between adjacent columns are placed next to each other is not an issue since they will both be actively addressed at the same time, which circumvents the high impedance scenario previous discussed.

Still referring to FIG. 25, pixels 22 in the odd rows have internal nodes that are coupled to data line D_odd via parasitic capacitance 210, whereas pixels 22 in the even rows have internal nodes that are coupled to data line D_even via parasitic capacitance 212. Because the pixels from row-to-row are mirrored, the distance between the internal nodes and the corresponding data lines should be equidistant. Thus, parasitic capacitance 210 should be identical to parasitic capacitance 212, thereby minimizing any row-to-row difference is eliminated and solving the content-dependent non-uniformity problem between odd and even rows.

Figure 26:
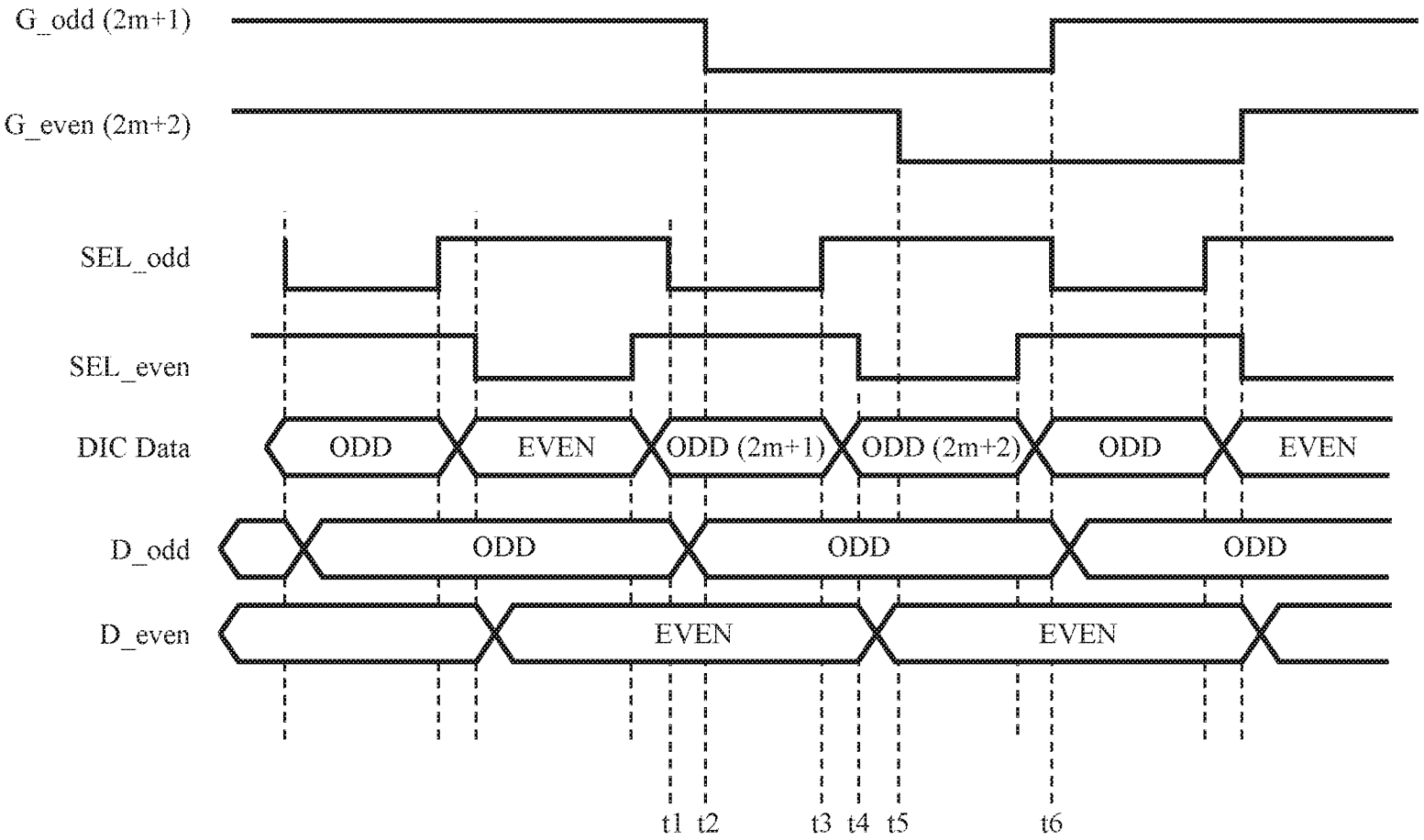
FIG. 26 is a timing diagram showing illustrative waveforms associated with the operation of the display pixel array shown in FIG. 25 in accordance with an embodiment.

FIG. 26 is a timing diagram showing illustrative waveforms associated with the operation of the display pixel array shown in FIG. 25 in accordance with an embodiment. At time t1, signal SEL_odd may be asserted to pass display driver integrated circuit ("DIC") data for row "2m+1" onto corresponding odd data lines D_odd. At time t2, gate line signal G_odd(2m+1) is driven low to turn on data loading transistors 200 to pass the data signals from the odd data lines onto row "2m+1".

At time t3, signal SEL_odd may be deasserted (e.g., driven high), which allows data lines D_odd to float. Thus, between time t2 and t3, data lines D_odd are actively driven by the data line drivers, but data lines D_odd will be in a high impedance state after SEL_odd is deasserted. At time t4, signal SEL_even may be asserted to pass DIC data for row "2m+2" onto corresponding data lines D_even. When the voltage on D_even changes at this point, there will be no data kicking to D_odd since parasitic capacitance 202 is low. At time t5, gate line signal G_odd(2m+2) is asserted to turn on data loading transistors 200 to pass the data signals from the even data lines onto row "2m+2". At time t6, gate line signal G_odd(2m+1) is driven high to turn off the corresponding data loading transistors 200. In contrast to the example of FIG. 23, the operation shown in FIG. 26 experiences no vertical crosstalk.

The foregoing is merely illustrative and various modifications can be made to the described embodiments. The foregoing embodiments may be implemented individually or in any combination.

What is claimed is:

1. A display, comprising:

an array of display pixels arranged in rows and columns;

an odd data line that is coupled to display pixels in odd rows within a given column of display pixels in the array, wherein the display pixels in the odd rows within the given column exhibit are coupled to the odd data line via a first amount of parasitic capacitance;

a first gate line coupled to display pixels in a given one of the odd rows;

an even data line that is coupled to display pixels in even rows within the given column of display pixels in the array, wherein the display pixels in the even rows within the given column are coupled to the even data line via a second amount of parasitic capacitance equal to the first amount of parasitic capacitance, wherein the odd data line is formed on a first side of the given column, and wherein the even data line is formed on a second side of the given column that is different than the first side to reduce vertical data line crosstalk;

a second gate line coupled to display pixels in a given one of the even rows; and demultiplexer circuitry coupled to the odd and even data lines, wherein the demultiplexer circuitry is configured to:

actively drive a first data signal onto the odd data line while asserting the first gate line to access a selected display pixel in the given one of the odd rows; and actively drive a second data signal onto the even data line while asserting the second gate line to access a selected display pixel in the given one of the even rows.

2. The display of claim 1, wherein the odd and even data lines are formed on opposing sides of the given column of display pixels.

3. The display of claim 1, wherein the display pixels in the odd rows in the given column have a different orientation than the display pixels in the even rows in the given column.

4. The display of claim 3, wherein the display pixels in the odd rows in the given column mirrored with respect to the display pixels in the even rows in the given column.

5. The display of claim 1, further comprising:

an additional odd data line that is coupled to display pixels in the odd rows within an additional column of display pixels in the array; and an additional even data line that is coupled to display pixels in the even rows within the additional column of display pixels in the array, wherein the demultiplexer circuitry is also coupled to the additional odd data line and the additional even data line.

6. The display of claim 5, wherein the additional even data line is formed closer to the even data line than the additional odd data line.

7. The display of claim 5, wherein the additional odd data line is formed closer to the odd data line than the additional even data line.

8. The display of claim 5, wherein the display pixels in the given column have a different orientation than the display pixels in the additional column.

9. The display of claim 8, wherein the display pixels in the given column mirrored with respect to the display pixels in the additional column.

10. The display of claim 1, wherein the demultiplexer circuitry comprises:

a first transistor coupled between a driver circuit and the odd data line; and a second transistor coupled between the driver circuit and the even data line, wherein the first transistor is configured to receive an odd selection signal, and wherein the second transistor is configured to receive an even selection signal.

11. A method of operating a display that includes at least one column of pixels that is coupled to an odd data line and an even data line, the method comprising:

driving a first data signal onto the odd data line;

asserting a first gate line signal to access a selected pixel in the column of pixels while the first data signal is actively being driven onto the odd data line;

allowing the data line to be in a high impedance state; and while the data line is in the high impedance state, driving a second data signal onto the even data line, wherein a corresponding voltage change on the even data line caused by the second data signal is not coupled to the odd data line.

12. The method of claim 11, wherein asserting the first gate line signal comprises loading the first data signal from the odd data line into the selected pixel.

13. The method of claim 12, further comprising asserting a second gate line signal to access an additional pixel in the column of pixels.

14. The method of claim 13, wherein asserting the second gate line signal comprises loading the second data signal from the even data line into the additional pixel.

15. The method of claim 13, wherein the selected pixel includes a first data loading transistor, wherein the additional pixel includes a second data loading transistor, wherein the first data loading transistor is separated from the odd data line by a first distance and wherein the second data loading transistor is separated from the even data line by a second distance that is equal to the first distance.

16. The method of claim 11, wherein the odd and even data lines are not immediately adjacent to each other.

17. A display comprising:

a column of pixels;

a first data line that is formed on one side of the column, wherein the first data line is coupled to pixels in odd rows of the column and wherein the pixels in the odd rows of the column exhibit a first amount of parasitic capacitance to the first data line;

a first scan line coupled to a first pixel in the column of pixels, wherein the first scan line is asserted to access the first pixel while a first data signal is actively being driven onto the first data line;

a second data line that is formed on another side of the column, wherein the second data line is coupled to pixels in even rows of the column and wherein the pixels in the even rows of the column exhibit a second amount of parasitic capacitance to the second data line that is equal to the first amount of parasitic capacitance; and a second scan line coupled to a second pixel in the column of pixels, wherein the second scan line is asserted to access the second pixel while a second data signal is actively being driven on the second data line.

18. The display of claim 17, wherein the pixels in the odd rows have a different orientation than the pixels in the even rows.

19. The display of claim 17, wherein only one of the first and second data lines is actively driven at any point in time during operation of the display.

* * * * *